US009429355B2

(12) United States Patent
Seo et al.

(10) Patent No.: US 9,429,355 B2
(45) Date of Patent: Aug. 30, 2016

(54) REFRIGERATOR

(71) Applicant: LG ELECTRONICS INC., Seoul (KR)

(72) Inventors: Woonkyu Seo, Changwon-si (KR); Seonkyu Kim, Changwon-si (KR); Seungjin Yoon, Changwon-si (KR); Jungyeon Hwang, Changwon-si (KR); Daesung Lee, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 13/666,052

(22) Filed: Nov. 1, 2012

(65) Prior Publication Data

US 2013/0119845 A1 May 16, 2013

(30) Foreign Application Priority Data

Nov. 15, 2011 (KR) ..... 10-2011-0118955
Nov. 18, 2011 (KR) ..... 10-2011-0120774

(51) Int. Cl.

| | |
|---|---|
| ***A47B 97/00*** | (2006.01) |
| ***A47B 96/04*** | (2006.01) |
| ***F25D 23/02*** | (2006.01) |
| ***F25D 23/04*** | (2006.01) |

(52) U.S. Cl.

CPC ..... *F25D 23/025* (2013.01); *F25D 23/04* (2013.01); *F25D 2323/023* (2013.01)

(58) Field of Classification Search

CPC . F25D 23/025; F25D 23/04; F25D 2323/023
USPC ..... 312/405.1, 405, 291, 292
See application file for complete search history.

(56) References Cited

U.S. PATENT DOCUMENTS

| | | | | |
|---|---|---|---|---|
| 1,927,398 | A * | 9/1933 | Glasser | 62/377 |
| 1,984,977 | A * | 12/1934 | Mize | 312/276 |
| 2,131,680 | A * | 9/1938 | Zahodiakin | 62/266 |
| 2,135,878 | A * | 11/1938 | Sekyra, Sr. | 62/252 |
| 2,150,064 | A * | 3/1939 | Robert et al. | 62/266 |
| 2,917,355 | A * | 12/1959 | Squire | 312/405.1 |
| 2,942,438 | A * | 6/1960 | Schmeling | 62/377 |
| 2,945,733 | A * | 7/1960 | Malia | 312/200 |
| 7,651,182 | B2 * | 1/2010 | Eveland et al. | 312/405.1 |

(Continued)

FOREIGN PATENT DOCUMENTS

| | | |
|---|---|---|
| CN | 2913985 Y | 6/2007 |
| CN | 101542223 A | 9/2009 |

(Continued)

OTHER PUBLICATIONS

Chinese Office Action dated Jul. 28, 2014 issued in Application No. 201210459287.5.

*Primary Examiner* — Daniel J Troy
*Assistant Examiner* — Timothy M Ayres
(74) *Attorney, Agent, or Firm* — KED & Associates LLP

(57) ABSTRACT

A refrigerator is provided. The refrigerator may include a moving basket installed in a storage case provided in a door or main body of the refrigerator. The moving basket may be vertically movable within the storage case. A height of the moving basket may be adjustable by an operation mechanism, to efficiently utilize an inner space of the storage assembly.

17 Claims, 20 Drawing Sheets

(56) References Cited

U.S. PATENT DOCUMENTS

| | | | | |
|---|---|---|---|---|
| 2003/0011291 | A1* | 1/2003 | Moreno-Olguin et al. | 312/405.1 |
| 2010/0031690 | A1* | 2/2010 | Becke | 62/377 |
| 2010/0176702 | A1* | 7/2010 | Kim | 312/405.1 |
| 2010/0270902 | A1* | 10/2010 | Kim et al. | 312/405.1 |
| 2010/0326122 | A1* | 12/2010 | Seo et al. | 62/449 |
| 2011/0023528 | A1* | 2/2011 | Kwon et al. | 62/441 |
| 2012/0293056 | A1* | 11/2012 | Kim | 312/405.1 |

FOREIGN PATENT DOCUMENTS

| | | | |
|---|---|---|---|
| CN | 101929784 | A | 12/2010 |
| CN | 102230713 | A | 11/2011 |
| JP | 2000-065459 | A | 3/2000 |
| WO | WO 2004/059228 | A1 | 7/2004 |
| WO | WO 2011/093577 | A1 | 8/2011 |

* cited by examiner

REFRIGERATOR

CROSS-REFERENCE TO RELATED APPLICATION(S)

This application claims priority under 35 U.S.C. §119 from Korean Application Nos. 10-2011-0118955 filed on Nov. 15, 2011 and 10-2011-0120774 filed on Nov. 18, 2011, whose entire disclosures are hereby incorporated by reference.

BACKGROUND

1. Field

Embodiments as broadly described herein may relate to a refrigerator, and more particularly, to a refrigerator that may store items in an internal compartment, closable by an internal door.

2. Background

A refrigerator may store items at a temperature lowered by cold air generated by a freezing cycle including a compressor, a condenser, an expansion valve and an evaporator. Such a refrigerator may include a freezer compartment for storing items in a frozen state therein and a refrigerator compartment for storing items at a relatively low temperature. A Kimchi refrigerator may preserve items such as Kimchi and vegetables in a fresh state. One or more doors may be connected to a predetermined portion of a case of the refrigerator by a hinge to rotate to open and close a front of the case. Additionally, a drawer type door may be coupled to a front of a drawer that is slidably received in the case. A plurality of shelves may be provided in the various compartments.

BRIEF DESCRIPTION OF THE DRAWINGS

The embodiments will be described in detail with reference to the following drawings in which like reference numerals refer to like elements wherein.

Arrangements and embodiments may be described in detail with reference to the following drawings in which like reference numerals refer to like elements and wherein.

DETAILED DESCRIPTION

Exemplary embodiments will be described in detail, referring to the accompanying drawings as follows.

Figure 1:
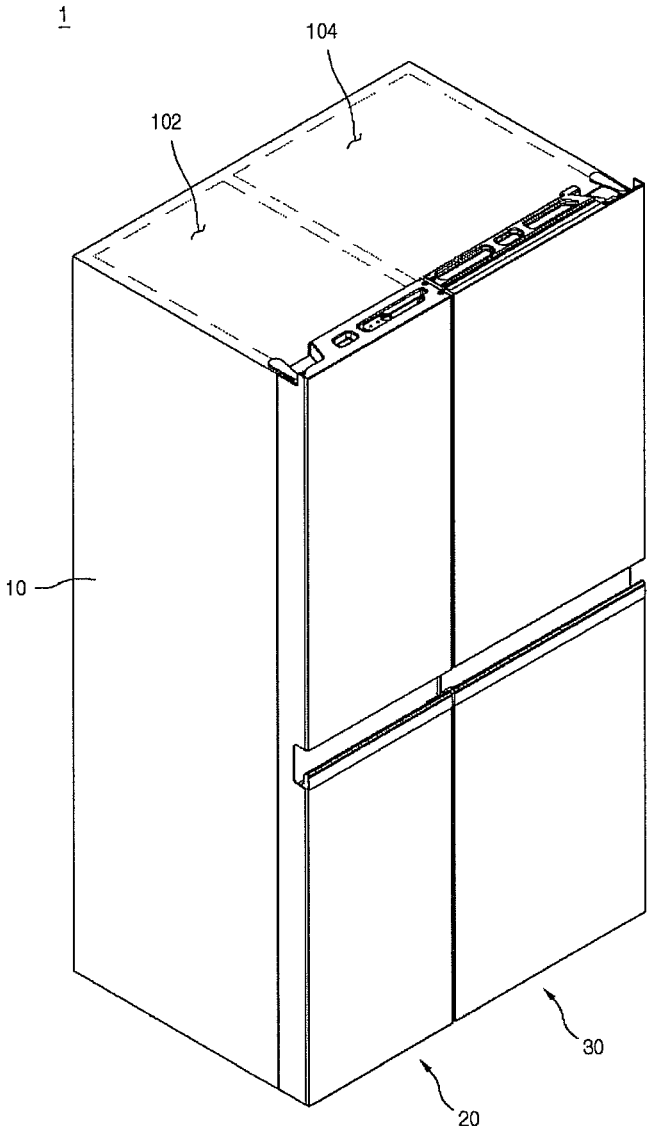
FIG. 1 is a perspective view of a refrigerator in accordance with one embodiment as broadly described herein.
Figure 2:
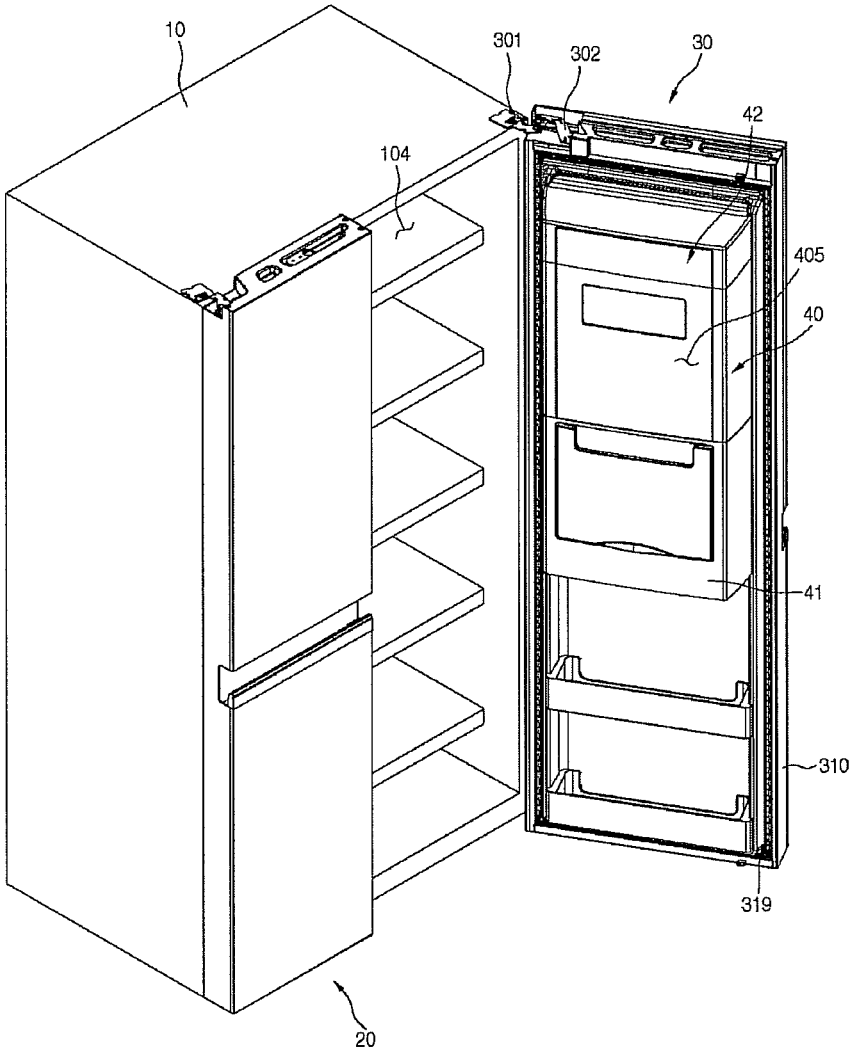
FIG. 2 is a perspective view of the refrigerator shown in FIG. 1, with a first storage chamber open.
Figure 3:
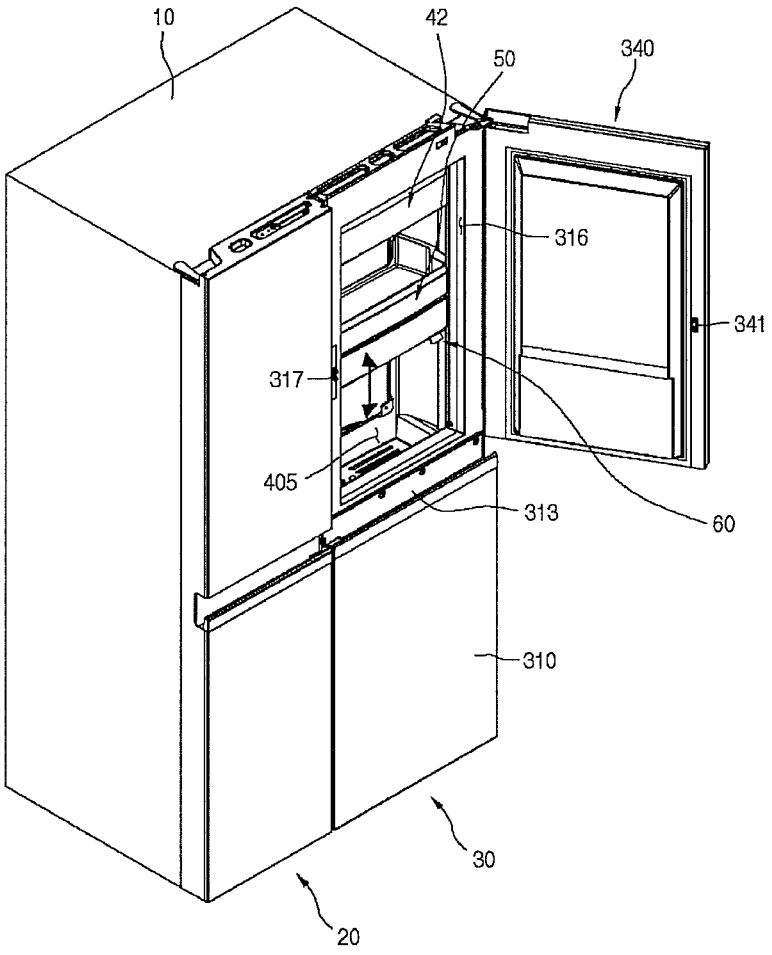
FIG. 3 is a perspective view of the refrigerator shown in FIG. 1, with a second storage chamber open.

Referring to FIGS. 1 to 3, a refrigerator 1 as embodied and broadly described herein may include a cabinet 10 in which a storage chamber is formed and doors 20 and 30 for opening and closing the storage chamber. The storage chamber may include, for example, a freezer compartment 102 and a refrigerator compartment 104, arranged, for example, side by side, and partitioned by a partition. The doors 20 and 30 may include a freezer door 20 for opening and closing the freezer compartment 102 and a refrigerator door 30 for opening and closing the refrigerator compartment 104.

A storage assembly 40 may be provided on a rear (i.e., interior facing) surface of the refrigerator door 30. The storage assembly 40 may include a storage case 41 detachably coupled to the rear surface of the refrigerator door 30. In a state in which the refrigerator door 30 is closed against the refrigerator compartment 104, the storage case 41 may be positioned in the refrigerator compartment 104. In this embodiment, the refrigerator compartment 104 may be referred to as a first storage chamber and the space formed by the storage case 41 may be referred to as a second storage chamber 405. Accordingly, the refrigerator door 30 may close the first storage chamber 104 and the second storage chamber 405 may then be positioned in the first storage chamber 104.

The refrigerator door 30 may include a first door 310 for opening and closing the first storage chamber 104 and a second door 340 rotatably coupled to the first door 310 for opening and closing the second storage chamber 405. The first and second doors 310 and 340 may be pivotally installed by a hinge assembly including a first hinge 301 for connecting the first door 310 to the cabinet 10 and a second hinge 302 for connecting the second door 340 to the first door 310.

An opening 316 may be formed in the first door 310 to provide for access to the interior of the second storage chamber 405. The size of the opening 316 formed in the first door 310 may correspond to the size of the open front face of the storage assembly 40. Accordingly, when the second door 340 pivots with respect to the first door 310 while the first door 310 is in a closed position against the first storage chamber 104, the opening 316 may be uncovered to provide access to the second storage chamber 405.

A latch hook 341 may be provided at a rear surface of the second door 340 to couple and latch the second door to the first door 310. A latch slot 317 may be formed in the first door 310 to couple the latch hook 341 thereto. The positions of the latch hook 341 and the latch slot 317 may be reversed.

When the first door 310 is closed against the first storage chamber 104 and the second door 340 is closed against the first door 310, and a front surface of the second door 340 is pushed, the coupling between the latch hook 341 and the latch slot 317 may be released to allow the second door 340 to pivot and provide access to the second storage chamber 405.

A seal 319 may be provided at the rear surface of the first door 310 to prevent outflow of cold air from the inside the first storage chamber 104. A magnet may be provided in the seal 319 and the front surface of the cabinet 10 so that the magnetic attraction of the magnet may maintain the closed state of the first door 310 against the first storage chamber 104.

A grip 313, or handle, may be formed in the front surface of the refrigerator and freezer doors 30 and 20. The grip 313 may be formed, for example, horizontally with respect to the refrigerator and freezer doors 30 and 20, and may be, for example, pocket-shaped to be held by the user easily. The grips 313 formed in the refrigerator and freezer doors 30 and 20, respectively, may be connected with each other for overall design uniformity.

The grips 313 may be positioned at an appropriate grasping height, such as, for example, approximately at a center of the overall height of the refrigerator and freezer doors 30 and 20. The grips 313 may be positioned at a lower end of the opening, namely, a lower end of the second door 340. Specifically, when closed, right and left ends of the second door 340 may be located at the same positions as right and left ends of the first door 310. Upper and lower ends of the second door 340 may be positioned at the same positions as an upper end of the first door 310 and the grips 313, respectively. Accordingly, as seen from the front in the state in which the second door 340 is closed, an outline of the second door 340 is not exposed. The second door 340 may be hidden by the shapes/contours of the first door 310 and the grips 313. Such a visual effect may improve/enhance a front design of the refrigerator 1. Other handle/grip arrangements may also be appropriate.

Figure 4:
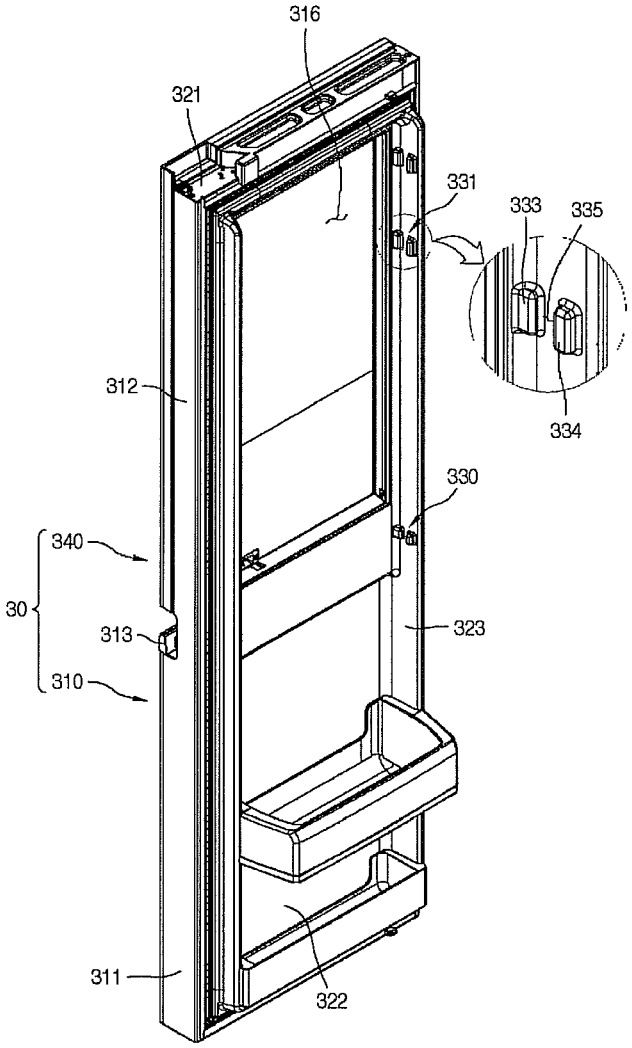
FIG. 4 is a rear perspective view of a door of the refrigerator shown in FIG. 2, with a storage assembly removed.

FIG. 4 is a perspective view of a rear, or interior facing, surface of the refrigerator door 30, in a state in which a storage assembly according to an embodiment as broadly described herein has been detached.

As shown in FIG. 4, a lateral surface of the first door 310 may be stepped. Specifically, the first door 310 may include a first portion 311 and a second portion 312 that extends upward from the first portion 311. The second portion 312 may be thinner than the first portion 311 to at least partially accommodate the thickness of the second floor 340. The opening 316 may be formed in the second portion 312 of the first door 310, and the second door 340 may be connected with the second portion 312 to open and close the opening 316 and the second storage chamber 405.

The grip 313 may be formed on the first portion 311 and may extend upward from an upper surface of the first portion 311. To allow the user to grasp the grip 313, the grip 313 may be spaced apart a predetermined distance from a front surface of the second portion 312 and a lower surface of the second door 340. In other words, a vertical length of the second door 340 may be smaller than that of the second portion 312 to provide a space for access to the grip 313. When the user pulls the grip 313, the first door 310 may be pivoted to open the first storage chamber 104.

The first door 310 may include an outer case 321 and a door liner 322 coupled to the outer case 321 and facing the interior of the first storage chamber 104 when the first door 310 is in the closed position. The door liner 322 may include a plurality of dikes 323 extending longitudinally in a vertical direction and spaced apart horizontally. A plurality of first couplers 330 and 331 may be arranged a predetermined distance apart in a vertical direction along the dikes 323. The storage assembly 40 and the one or more baskets may be at least partially positioned between the dikes 323.

Each of the first couplers 330 and 331 may include a first projection 333 and a second projection 334 spaced apart a predetermined distance from each other in a front-and-rear direction so that a predetermined space 335, that is, a predetermined distance, is formed between the first projection 333 and the second projection 334. The first projection 333 may be positioned adjacent to the opening 316 of the first door 310. A distance between the first projection 333 and the opening 316 may be less than a distance between the second projection 334 and the opening 316.

The storage assembly 40 may be mounted in a predetermined position on the rear surface of the first door 310, corresponding to the opening 316. The storage assembly 40 will be described in detail as follows, referring to FIG. 5, which is a perspective view of the storage assembly, and FIG. 6, which is an exploded perspective view of the storage assembly.

Figure 5:
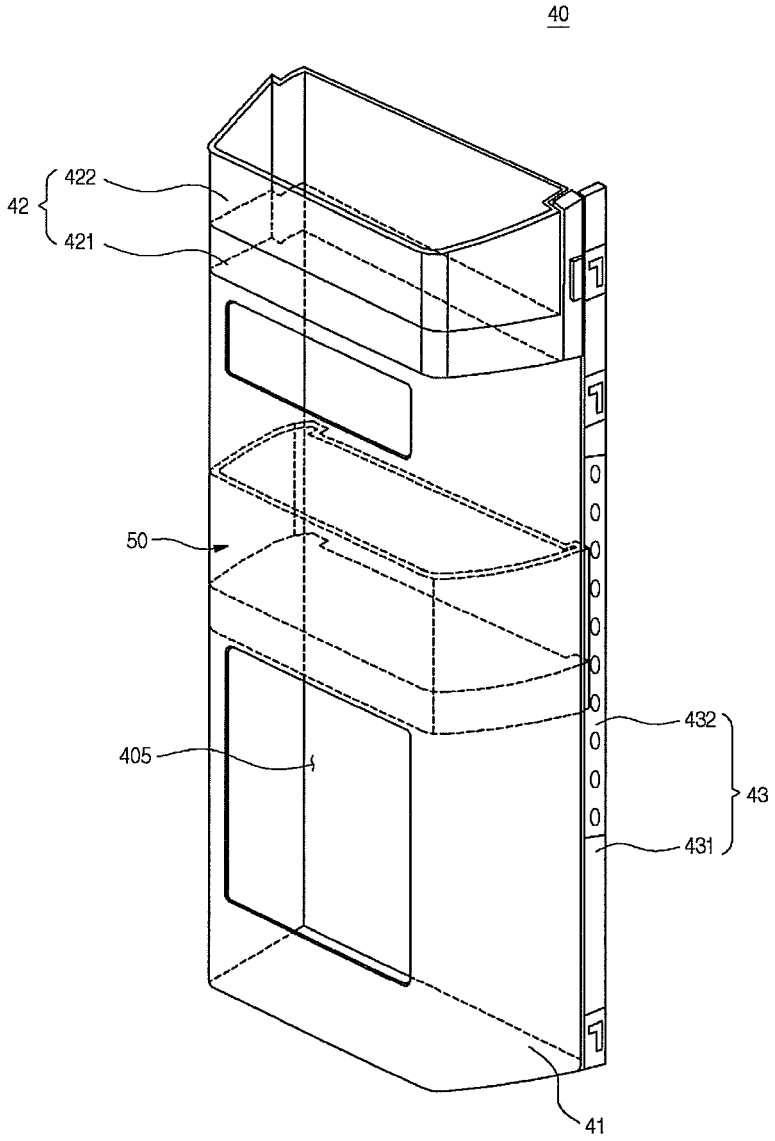
FIG. 5 is a perspective view of a storage assembly of the door of the refrigerator shown in FIG. 2.
Figure 6:
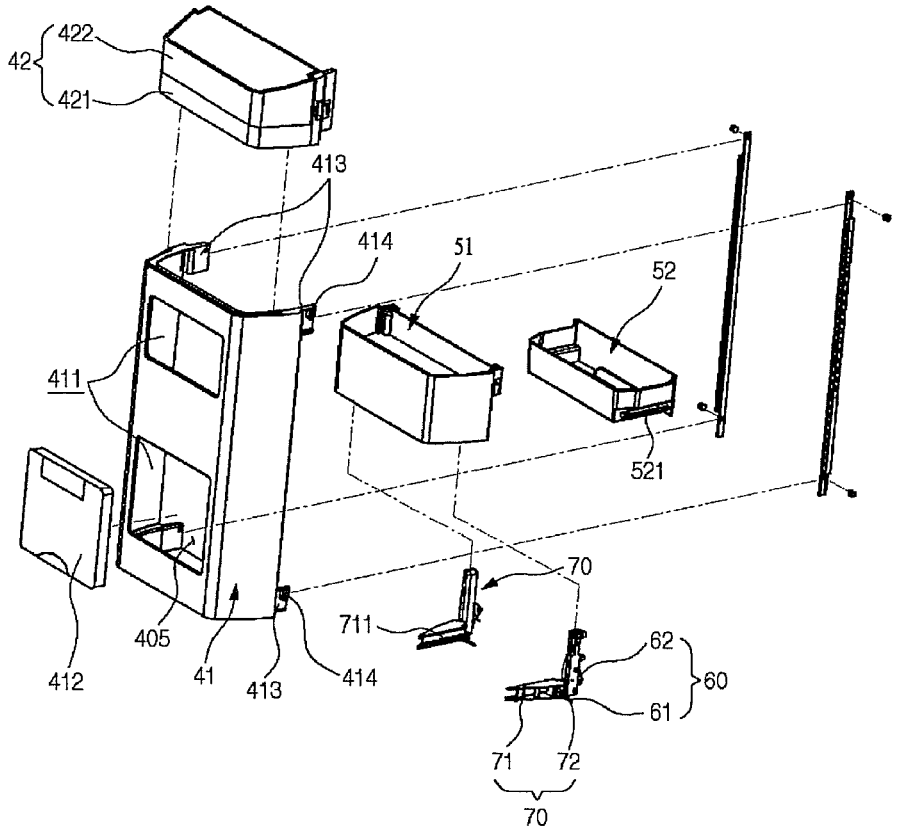
FIG. 6 is an exploded perspective view of the storage assembly shown in FIG. 5.

Referring to FIGS. 5 and 6, the storage assembly 40 may include a storage case 41 and a plurality of baskets 42 and 50 arranged in the storage case 41 in a vertical direction, spaced apart a predetermined distance. The baskets 42 and 50 may be positioned in the storage case 41 to be accessible via the opening 316 when the second door 340 is open.

The plurality of baskets 42 and 50 may include, for example, an upper basket 42 and a moving basket 50 arranged below the upper basket 42, the moving basket 50 being movable in a vertical direction.

The upper basket 42 may be arranged in an upper end area of the storage case 41 and may partially define an upper area of the storage case 41. The upper basket 42 may be detachably provided in the storage case 41 and may include a basket tray 421 receiving storage items thereon and a basket cover 422 pivotally provided in the basket tray 421. Accordingly, the upper basket 42 may be accessed by pivoting the basket cover 422 when the first door 310 is open. Such an upper basket 42 may be used as, for example, a dairy corner in which dairy items are stored.

The moving basket 50 may be mounted in a rail assembly 43 provided along right and left ends of the storage case 41. The moving basket 50 may slide in a vertical direction in an inner space of the storage case 41 when mounted in the rail assembly 43. The moving basket 50 may include an operation mechanism 60 that may selectively restrict operation of the storage case 41 and the rail assembly 43 to fix the moving basket 50 at a desired height. The structure of the moving basket 50 will be described in detail as follows.

The storage case 41 may form the second storage chamber 405 with the upper basket 42 fixed therein. The open front surface of the storage case 41 may correspond to the opening 316.

The inner space of the storage case 41 may be divided into upper and lower spaces with respect to the moving basket 50. Storage rooms may be formed in the upper and lower spaces divided with respect to the moving basket 50. As the moving basket 50 moves, the distance between a bottom surface of the storage case 41 and the moving basket 50 may be adjusted and a space proportion inside the storage case 41 may be adjusted.

At least one cold air hole 411 may be formed in a rear surface of the storage case 41 to supply cold air to the inner space of the storage case 41 from the interior of the refrigerator. A case door 412 may open and close the at least one cold air hole 411.

A fixing part 413, or fixing bracket 413, may project forward from each front end of lateral surfaces of the storage case 41. A plurality of fixing parts 413, or fixing brackets 413, may project forward from the right and left lateral surfaces, specifically, from upper and lower ends of each of the right and left lateral surfaces. A second coupler 414 may be formed in an outer surface of each fixing part 413 and may be coupled to the first couplers 330 and 331 to mount the storage case 41.

Upper and lower ends of the rail assembly 43 may be connected with the fixing parts 413 formed in the upper and lower ends of the storage case 41.

The rail assembly 43 may be positioned at a front end of the storage case 41 and may be arranged to connect to the fixing parts 413 positioned at the upper and lower ends of the storage case 41. When mounting the storage case 41, the rail assembly 43 may be arranged on the rear surface of the first door 310. When viewed from the front of the first door 310, the rail assembly 43 may be hidden and unseen.

In particular, the rail assembly 43 may be positioned at right and left sides of the storage case 41, at an outside of the right and left ends of the opening 316, so that the rail assembly 43 is covered by the opening 316 and not exposed via the opening 316 when viewed from the front.

The rail assembly 43 may be injection-molded of a plastic material. The rail assembly 43 may include a rail cover 431 connecting and extending between the fixing parts 413 and a rail 432 mounted on the rail cover 431. The rail cover 431 may provide a mounting position of the rail 432 and couple the rail 432 thereto.

The rail 432 may be formed of metal and may enable the stable mounting of the moving basket 50. The rail 432 may receive a roller 415 provided in the moving basket 50 to guide the movement of the moving basket 50 when the moving basket 50 is moving. The rail cover 431 and the rail 432 provided in the rail assembly may be integrally formed or they may be molded of one material as a single part.

A plurality of adjusting holes 433 may be formed along a longitudinal direction of the rail 432 and the operation mechanism 60 may be partially restricted by one of the adjusting holes 433 to fix the moving basket 50 at a desired height.

The operation mechanism 60 may be connected to a bottom of the moving basket 50 and may include an operation lever 61 and a restricting member 62 in communication with the operation lever 61, such that the user may fix the moving basket 50 at a desired height according to the operation of the operation lever 61 exposed via the opening 316.

The moving basket 50 may define a predetermined space that is recessed in a downward direction. The moving basket 50 may include a main-basket 51 moving along the rail 432 in a vertical direction and a drawer 52 provided underneath the main-basket 51, the drawer 52 being slidable inward and outward with respect to the main-basket 51. A guide member 70 may be provided on the main-basket 51 to guide the inward and outward sliding-movement of the drawer 52 and the operation mechanism 60 may be coupled to the guide member 70.

The structure of the moving basket 50 and the operation mechanism 60 will now be described in detail with respect to FIGS. 7 and 8A-8B.

Figure 7:
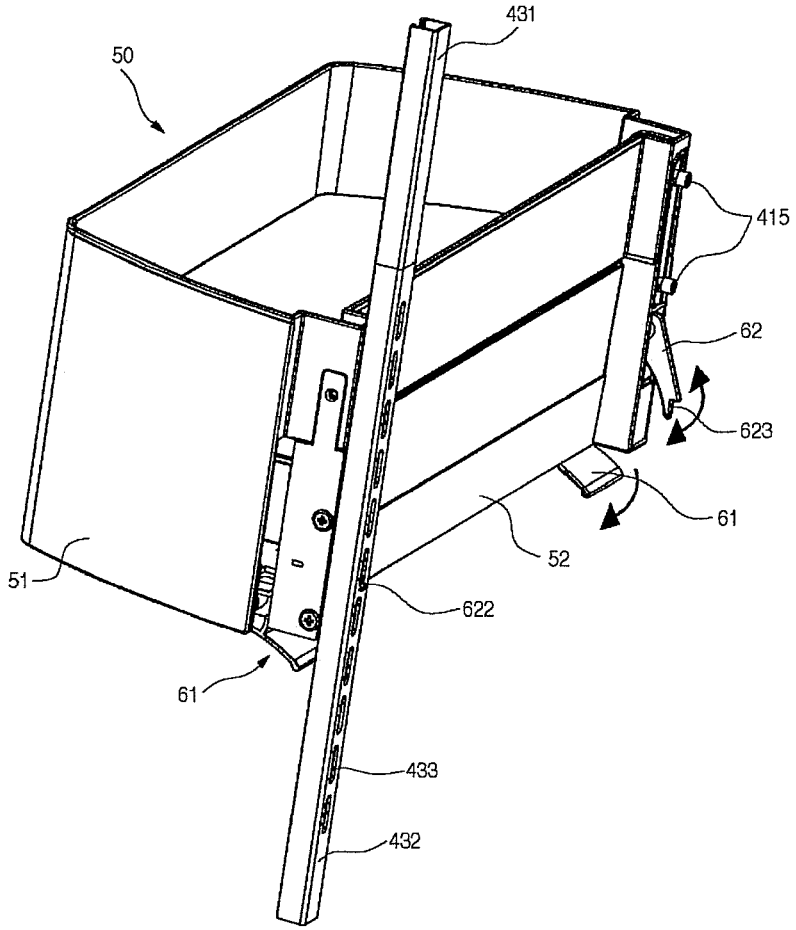
FIG. 7 is a perspective view of a moving basket of the storage assembly, in accordance with an embodiment as broadly described herein.
Figure 8A:
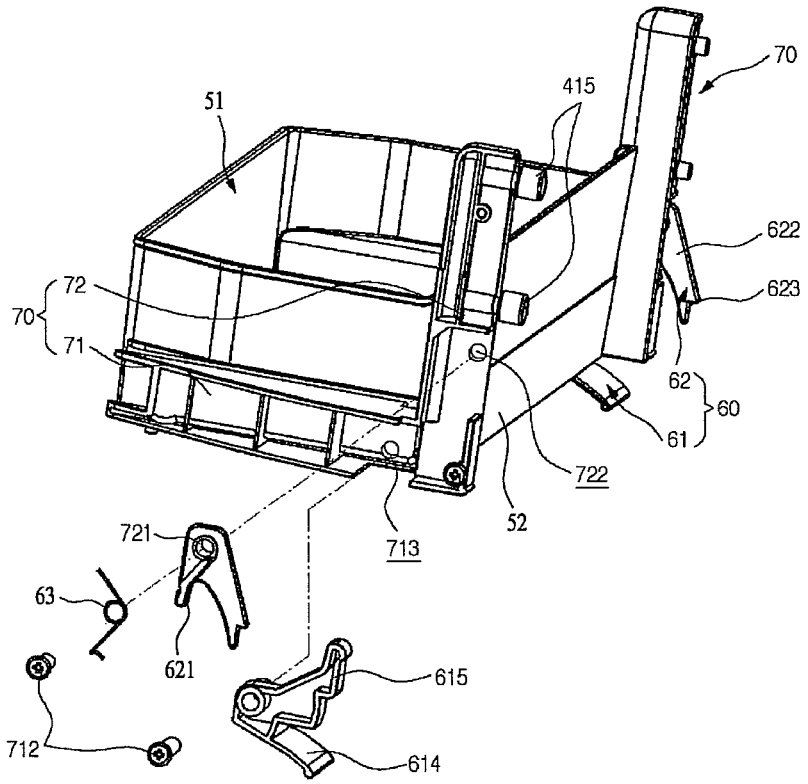
FIG. 8A is an exploded perspective view and FIG. 8B is an assembled perspective view of a connection state of an operation device of the moving basket shown in FIG. 7.
Figure 8B:
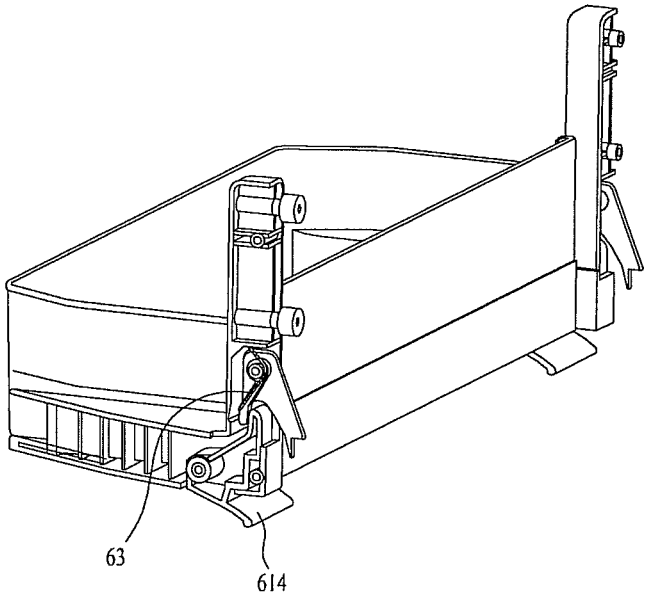

As shown in FIGS. 7 and 8A-8B, the recessed may be formed in the main-basket 51 and the drawer 52 may be positioned below main-basket 51. The guide member 70 may be mounted on left and right lateral surfaces of the main-basket 51. The drawer 52 may be coupled to the main basket 51 by the guide member 70 and may be movable outward (rightward, as shown in FIG. 7) by the guide member 70. Accordingly, the user may slide the drawer 52 outward via the opening 316 when the second door 340 is open. The drawer 52 may be completely accommodated in the lower area of the moving basket 50, below the main-basket 51, when it is moved inward.

The guide member 70 may be coupled to the right and left lateral surfaces of the main-basket 51. The guide member 70 may include a guide 71 guiding the drawer 52 and an extension 72 extending perpendicular from a front end of the guide 71. The guide 71 may include a guide groove 711 formed therein to receive a guide rib 521 of the drawer 52. Outer surfaces of the guides 71 may be fixed to respective lateral surfaces of the main-basket 51.

The extension 72 may extend from the front end of the guide 71 in an upward direction and may be exposed via right and left sides of the front surface of the storage case 41. The extension 72 may extend to an upper end of the main-basket 51 and may include a pair of rollers 415, spaced apart a predetermined vertical distance from each other, to enable stable vertical movement of the moving basket 50.

The operation mechanism 60 may be coupled to the guide member 70 provided at each of right and left lateral surfaces of the main-basket 51. The operation mechanism 60 may include the operation lever 61 and a restricting lever 62. The operation lever 61 may be pivotally coupled to a first rotation projection 712 projected from the guide 71 and an operation tab 614, operable by the user may be exposed through a first through-opening 713 of the guide 71. The operation tab 614 may extend obliquely via the first through-part 713 in downward and forward directions, such that the user may push the operation tab 614 via the opening 316.

A contacting part 615 of the operation lever 61 may extend upwardly to contact the restricting lever 62. The contacting part 615 may press an activating part 621 of the restricting lever 62 when the operation lever 61 is pivoted.

The restricting lever 62 may be pivotally coupled to a second rotation projection 721 formed in the extension 72 of the guide member 70. An elastic member 63 may be provided on the second rotation projection 721 to allow the activating part 621 to maintain contact with the contacting part 615. The restricting lever 62 may be returned to an initial position by a restoring force of the elastic member 63 after it is rotated.

A restricting part 622 of the restricting lever 62 may extend at an incline in forward and downward directions. The restricting part 622 may pass through a second through-part 722 formed in the extension 72. The restricting part 622 is extension 72 and be inserted in the rail 432 to fix the moving basket 50 in a particular position. A restricting groove 623 may be formed in an end of the restricting part 622 and hooked to a lower end of a selected adjusting hole 433 in the rail 432 to support the moving basket 50.

Operation of the moving basket having the structure described above will now be described in detail.

Figure 9:
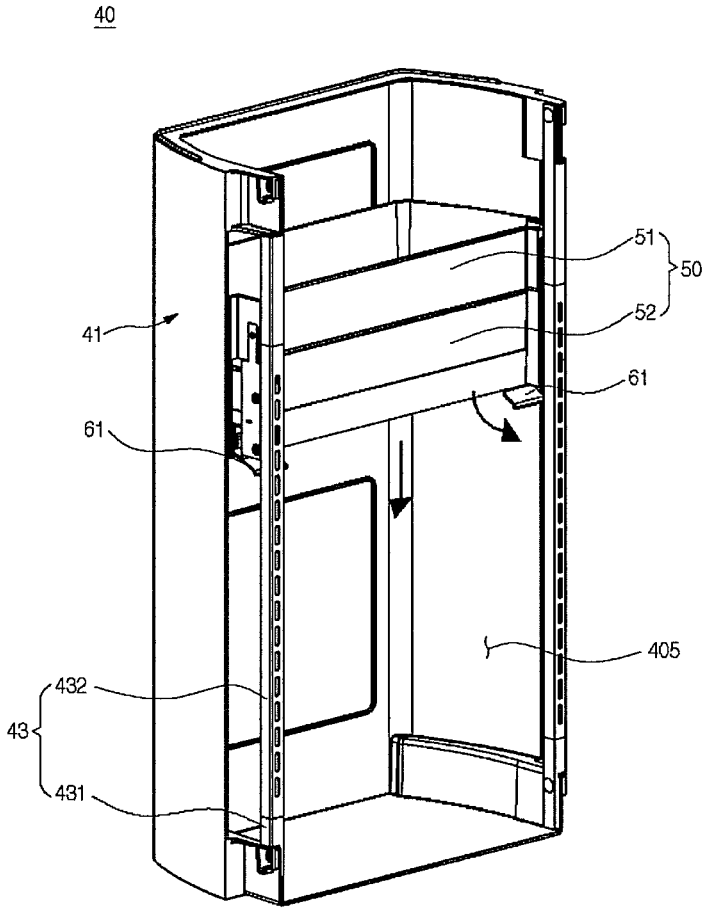
FIGS. 9 and 10 are perspective views illustrating a movement state of the moving basket shown in FIG. 7.
Figure 10:
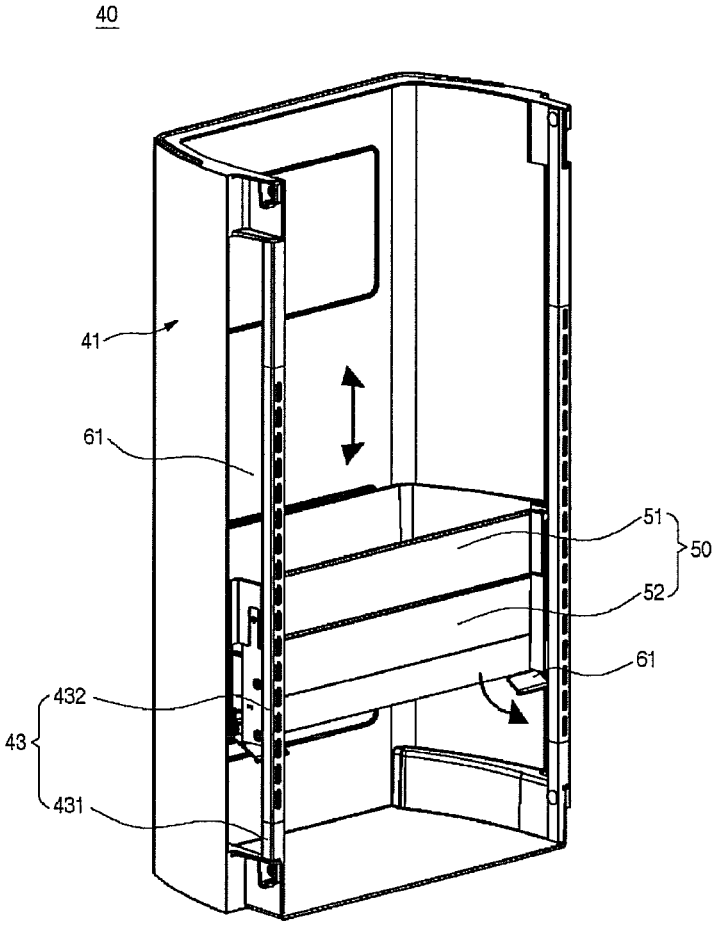

Referring to FIGS. 9 and 10, the second storage chamber 405 provided in the storage case 41 may be exposed via the opening 316 when the second door 340 is open relative to the first door 310. The user may place items in the storage case 41 via the opening 316.

The inner space of the storage case 41 may be partitioned into upper and lower spaces with respect to the moving basket 50. Accordingly, the moving basket 50 may be moved upward as shown in FIG. 9 to provide a lower space under the moving basket 50 that is sufficiently tall to accommodate relatively tall items in the lower space.

When tall items are stored in the main-basket 51, the moving basket 50 may be moved downward as shown in FIG. 10 to provide a sufficiently tall upper space. The user may move the moving basket 50 to adjust a space proportion inside the storage case 41.

The moving basket 50 is movable in up-and-down direction when mounted in the storage case 41. To move the moving basket 50, the operation mechanism 60 may be operated to selectively fix the moving basket 50 at a desired position. The operation lever 61 of the operation mechanism 60 may be exposed via the opening 316 when the second door 340 is open for manipulation by the user. The moving basket 50 may be fixed to a predetermined position on the rail 432 by the operation of the operation lever 61. More specifically, when the moving basket 50 is secured at a predetermined position and the user pushes the operation lever 61, the moving basket 50 may be released from and move vertically along the rail 432.

In other words, when the operation lever 61 is pushed, the operation lever 61 is pivoted and the contacting part 615 pushes the activating part 621 of the restricting lever 62, to pivot the restricting lever 62. The restricting part 622 is released from the adjusting hole 433 by the rotation of the restricting lever 62 and restriction between the restricting lever 62 and the rail 432 is released. Accordingly, the moving basket 50 may be moved along the rail 432 smoothly by the rollers 415.

After the user moves the moving basket 50 to a desired height, the user may remove the force applied to the operation lever 61 and the operation lever 61 may be restored by the elastic member 63, with the restricting groove 623 at the end of the restricting part 622 fitted into a new adjusting hole 433 of the rail 432 at the new height.

When the second door 340 is open, the drawer 52 mounted in the moving basket 50 may be exposed via the opening 316 and the user may move the drawer 52 outward to store items in the drawer 52.

After moving the moving basket 50 and/or the storing items in the second storage chamber 405 provided in the storage case 41, the second door 340 may be closed to close the opening 316.

Figure 11:
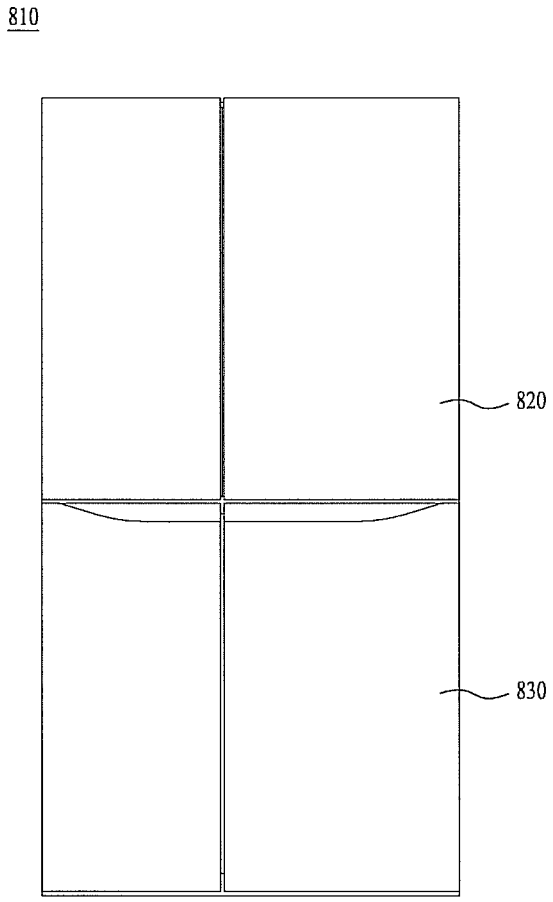
FIG. 11 is a front view of a refrigerator in accordance with another embodiment as broadly described herein.
Figure 12:
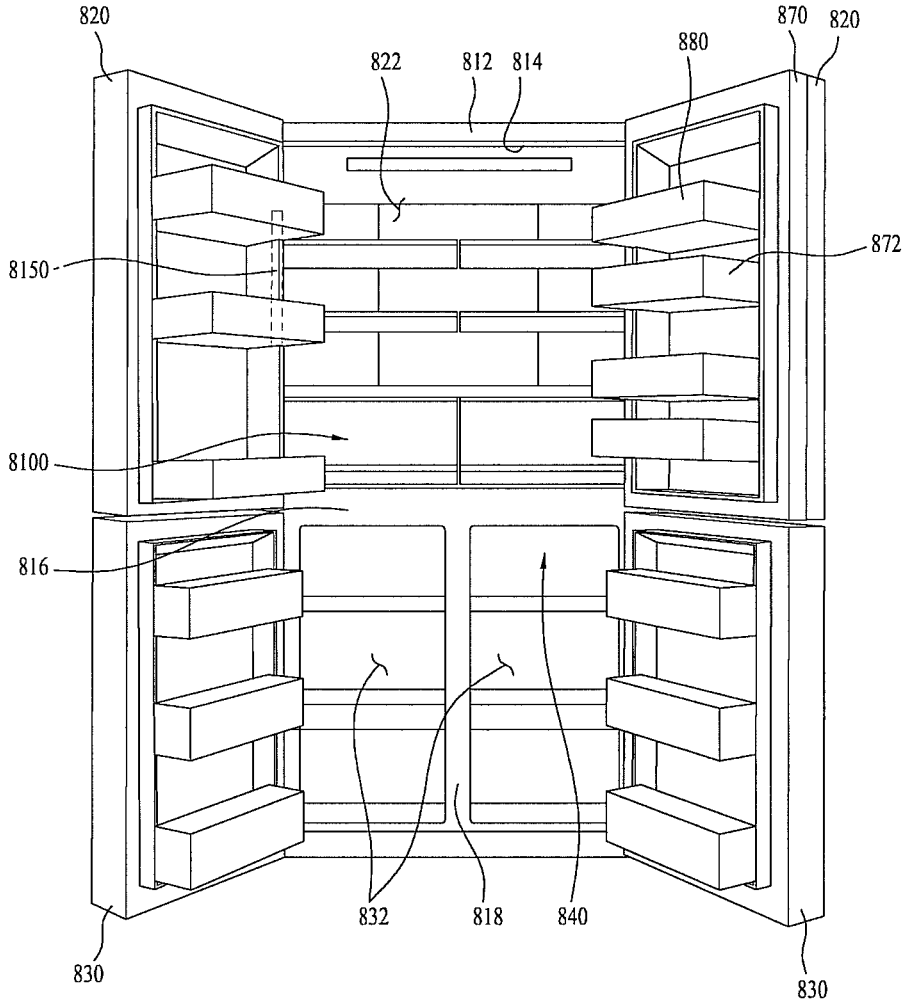
FIG. 12 is a front view of the refrigerator shown in FIG. 11, with its doors open.

FIG. 11 is a front view of a refrigerator according to another embodiment and FIG. 12 is a front view of the refrigerator shown in FIG. 11 with its door(s) open.

The refrigerator 810 shown in FIGS. 11 and 12 may include an outer case 812 for defining an overall exterior appearance, and an inner case 814 for defining a storage chamber in which items may be stored, namely, a freezer compartment 832 and a refrigerator compartment 822. A predetermined space may be formed between the outer case 812 and the inner case 814 and a passage where cold air is circulated may be formed in the space.

The refrigerator 810 may include a freezer door 830 for opening and closing the freezer compartment 832 and a refrigerator door 820 for opening and closing the refrigerator compartment 822. Ends of the freezer and refrigerator doors 830 and 820 may be pivotally coupled to the case of the refrigerator 810, for example, by hinges. In certain embodiments, a plurality of freezer doors and refrigerator doors may be provided. That is, as shown in FIG. 12, the refrigerator doors 820 and the freezer doors 830 may pivot forward from two opposite edges of the refrigerator 810.

A barrier 816 may be installed between the freezer compartment 832 and the refrigerator compartment 822 to partition the storage chamber into the freezer compartment 832 and the refrigerator compartment 822. The barrier 816 may have a predetermined thickness and may be formed in the inner case 814. The barrier 816 may extend horizontally and the freezer compartment 832 and the refrigerator compartment 822 may be partitioned vertically with respect to the barrier 816. Other arrangements may also be appropriate.

A partition wall 818 may also be installed in the freezer compartment 832 to partition the freezer compartment 832 into two partitioned spaces. The partition wall 818 may be vertically installed in the inner case 814 to form two side by side partitioned freezer compartments 832. Accordingly, the freezer doors 830 may open or close the freezer compartments separately.

In the exemplary refrigerator 810 shown in FIGS. 11 and 12, the refrigerator compartment 822 does not include a partition wall to partition the refrigerator compartment 822 into right and left spaces. However, a partition wall similar to the partition wall 818 provided in the freezer compartment 832 may be installed in the refrigerator compartment.

An inner door 870 may be installed in the refrigerator door 820 (that is, one or both of the refrigerator doors 820). The inner door 870 may be installed each of the two refrigerator doors 820 or it may be installed only in one of the refrigerator doors 820 as shown in FIG. 12. In certain embodiments, the inner door 870 may be installed on one or more of the freezer doors 830. The inner door 870 may be closer to the refrigerator compartment 822 than the refrigerator door 820. Accordingly, when the user opens only the refrigerator door 820 while the inner door 870 remains closed, the user may access items stored in a storage chamber provided in the inner door 870.

In certain embodiments, a shelf, a drawer, a basket and the like may be arranged in each of the freezer and refrigerator compartments 832 and 822. One or more drawers 840 movable inward and outward may be installed in the freezer compartment 832 and items may be stored in the drawer 840. A cover may be arranged on a front surface of the drawer 840 to preserve cold air in the freezer compartment 832 even when the freezer door 830 is open. A plurality of drawers 840 may be arranged in the freezer compartment 832 and the plurality of the drawers 840 may be arranged side by side with respect to the partition wall 818, and vertically along each side of the partition wall 818.

Auxiliary baskets 880 may be pivotally coupled to the inner door 870. Both ends of the auxiliary basket 880 may be fixed to the inner door 870 and a lower surface of the auxiliary basket 880 may be open. Accordingly, when the auxiliary basket 880 is moved upwardly, tall items may be stored in the auxiliary basket 880. When the auxiliary basket 880 is moved downwardly, smaller items may be stored in the auxiliary basket 880.

Meanwhile, a main-basket 872 may be fixed in the inner door 870 and arranged below the auxiliary basket 880, such that the main-basket 870 may be overlapped with or spaced apart a predetermined distance from the auxiliary basket 880 as the auxiliary basket 880 is moved.

A light source 8150 may be installed in the freezer compartment 832 and/or the refrigerator compartment 822 to irradiate light. When the user opens the freezer door 830 or the refrigerator door 820, the light source 8150 may be put into operation. The light source 8150 may emit light toward a rear area of the freezer compartment 832 and/or the refrigerator compartment 822 (i.e., an interior area of the freezer and/or refrigerator compartment).

Figure 13:
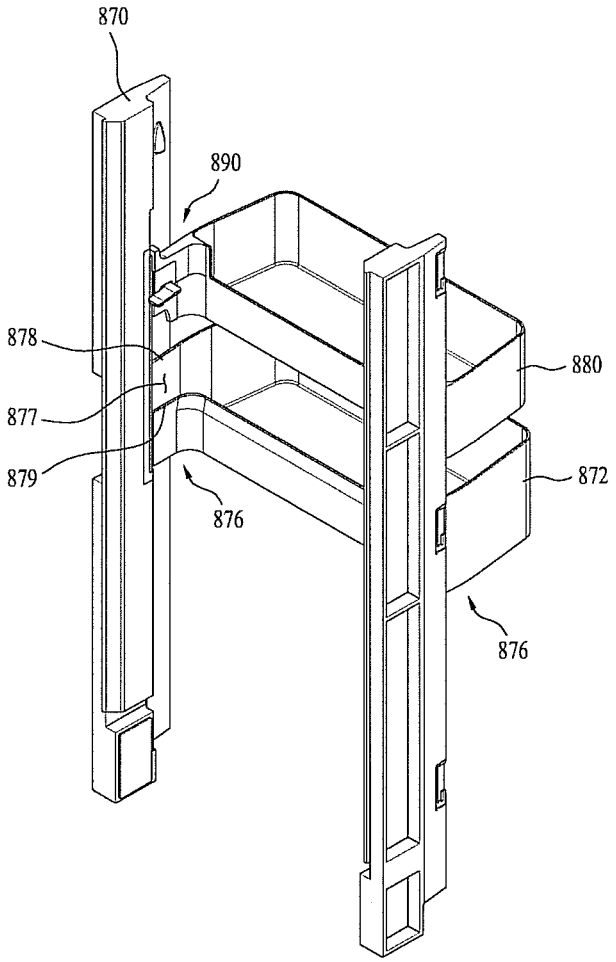
FIG. 13 is a front perspective view of a storage assembly of the refrigerator shown in FIGS. 11 and 12 in accordance with another embodiment.
Figure 14:
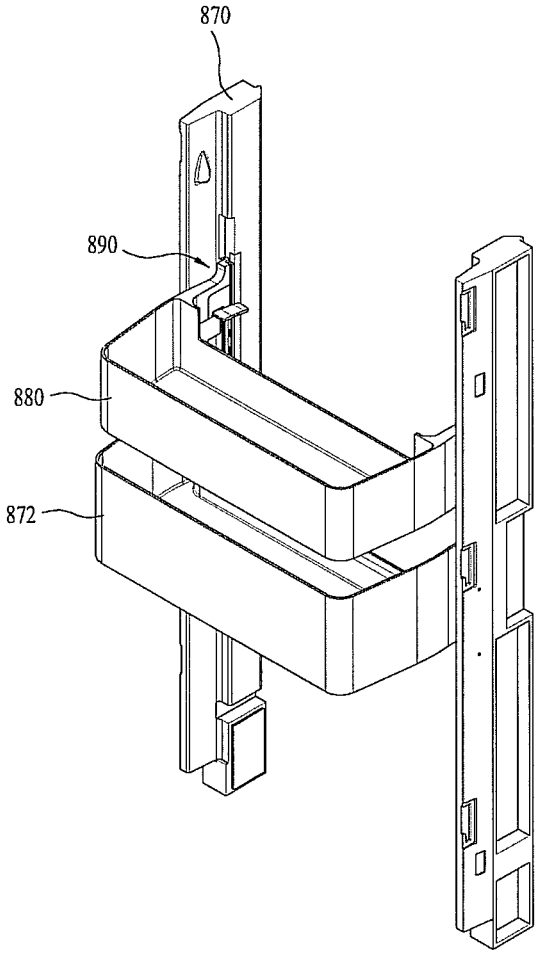
FIG. 14 is a rear perspective view of the storage assembly shown in FIG. 13.

FIG. 13 is a partial perspective view of the refrigerator shown in FIGS. 11 and 12, as seen from the front, and FIG. 14 is a partial perspective view, as seen from the rear.

In this embodiment the refrigerator may include an inner door 870 pivotally installed in a refrigerator door 820 or freezer door 830 and a main-basket 872 and an auxiliary basket 880 coupled to the inner door 870. In FIGS. 13 and 14, only two lateral frames of the inner door 870 are cut-away and illustrated, simply for ease of explanation and illustration. A side of the inner door 870 may be arranged adjacent to the pivoting hinge of the refrigerator door 820 or the freezer door 830 to enable the inner door 870 to pivot on the same axis as the refrigerator door 820 or the freezer door 830.

Although FIG. 12 shows that the inner door 870 is installed in the refrigerator door 820, it is well understood that the inner door may also installed in the freezer door 830 in a similar manner. Thus, the configuration of the inner door 870 installed in the refrigerator door 830 will not be described separately.

Also, for ease of explanation, the freezer and refrigerator doors 830 and 820 will hereafter be referred to as an outer door.

The main-basket 872 may be fixed in the inner door 870, without being adjustable in height/installation position. In contrast, the auxiliary basket 880 may be movably installed in the inner door 870 in a vertical direction.

A first fixing part 890 may couple the auxiliary basket 880 to the inner door 870 and a second fixing part 876 may couple the main-basket 872 to the inner door 870. The first fixing part 890 may allow the auxiliary basket 880 to move vertically with respect to the inner door 870 and the second fixing part 876 may fix the main-basket 872 at a predetermined position on the inner door 870.

The first fixing part 890 may connect two opposite ends of the auxiliary basket 880 to the inner door 870. Accordingly, two first fixing parts 890 may be formed in a predetermined shape corresponding to the two opposite ends of the auxiliary basket 880.

In certain embodiments, the first fixing part 890 may be arranged in front of a storage space formed in the auxiliary basket 880. The storage space may refer to an inner space of the auxiliary basket 880 that is approximately a rectangular parallelepiped, with an open top, so that items may be placed in or taken out via the open top.

Arranging the first fixing part 890 in front of the storage space allows the user to move the auxiliary basket 880 along an upward and downward direction easily, seeing the inner door 870, while not having to actually open the inner door 870.

In other words, when the user opens only the outer door, and not the inner door 870, the user may see the first fixing part 890 arranged in front and the storage space of the auxiliary basket 880 arranged behind the first fixing part 890 (in a direction in which the user views the freezer or refrigerator compartment from the outside).

The second fixing part 876 may include an accommodation space 877 for partially accommodating the first fixing part 890. The accommodation space 877 may have an approximately rectangular-parallelepiped-shape, as shown in FIG. 13.

The second fixing part 876 may include a first fixing piece 878 and a second fixing piece 879 each having a plate shape to separately connect the main-basket 872 to the inner door 870. Accordingly, the accommodation space 877 may be formed between the first fixing piece 878 and the second fixing piece 879, which may be spaced apart a predetermined distance from each other as shown in FIG. 13.

In certain embodiments, the height of the first fixing piece 878 may be different from that of the second fixing piece 879. For example, the first fixing piece 878 may be installed at an outside of the second fixing piece 879 and the first fixing piece 878 may be higher than the second fixing piece. The first fixing part 890 may include various components, projected inwardly, which may limit the moving range of the auxiliary basket 880 as it moves toward the top surface of the main-basket 872. In other words, the height of the second fixing piece 879 may be less than that of the first fixing piece 878, due to the limitation of the inwardly projected components provided in the first fixing part 890.

Like the first fixing part 890, a pair of second fixing parts 876 may connect two opposite ends of the main-basket 872 to the inner door 870. Accordingly, two second fixing parts 876 may be provided in symmetry with the two opposite ends of the main-basket 872.

In certain embodiments the auxiliary basket 880 may extend beyond the main-basket 872, and the sub-basket 880 may move downwardly to the same height as the main-basket 872. As the auxiliary basket 880 is connected to the inner door 870 by the first fixing part 890 and the main-basket 872 is connected to the inner door 870 by the second fixing part 876, the auxiliary basket 880 cannot move below the main-basket 872.

Rather, in certain embodiments, the lowest height of the auxiliary basket 880 moving downwardly may be to the position of the main-basket 872. When the auxiliary basket 880 is moved to the lowest limit, the bottom surface of the auxiliary basket 880 may contact the bottom surface of the main-basket 872, such that the main-basket 872 and the auxiliary basket 880 overlap each other, and the auxiliary basket 880 is essentially nested within the main basket 872.

Items with a high frequency of use such as, for example, water and other beverages, various healthy foods or side dishes may be stored in the main-basket 872 that forms the storage space of the inner door 870. Accordingly, when storing items such as tall beverage bottles, the auxiliary basket 880 may be moved vertically so that the main-basket 872 and the auxiliary basket 880 may be overlapped with each other to accommodate the tall item. When storing short items such as side dishes, the auxiliary basket 880 may be moved upward and two shelves may be installed to store various items.

Figure 17:
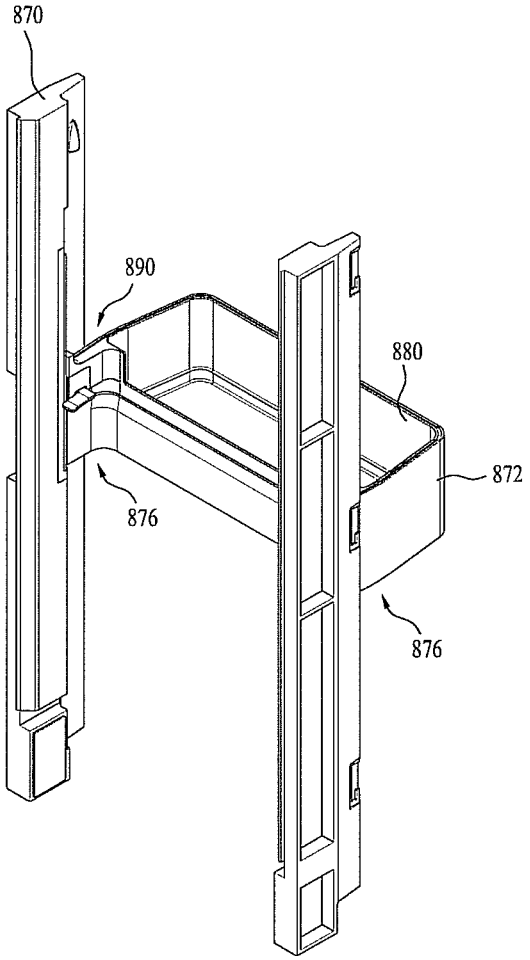
FIG. 17 illustrates a state in which a sub-basket of the storage assembly shown in FIG. 13 is moved and overlapped with a top surface of a main-basket.

Bottom surfaces of the auxiliary basket 880 and the main-basket 872 may be closed so that, when they overlap as shown in FIG. 17, the storage space formed by the auxiliary basket 880 and the storage space formed by the main-basket 872 correspond with each other and items may be substantially placed only in the auxiliary basket 880.

In this instance, when the auxiliary basket 880 and the main-basket 872 are overlapped with each other (i.e., the auxiliary basket 880 is positioned within the main basket 872) as shown in FIG. 17, a single storage space may be formed.

In contrast, when the auxiliary basket 880 and the main-basket 872 are spaced apart from each other, items may be stored in the auxiliary basket 880 and the main-basket 872 independently.

Figure 15:
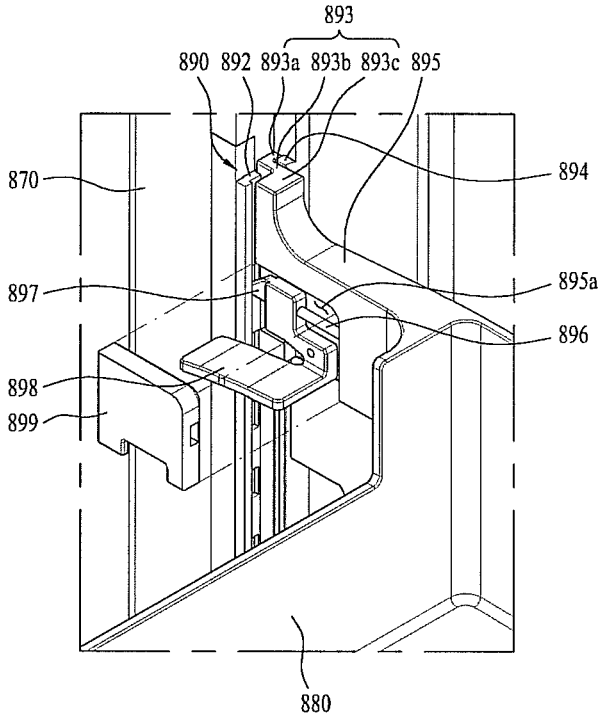
FIGS. 15 and 16 illustrate a state in which a cover of the storage assembly shown in FIG. 13 is open.
Figure 16:
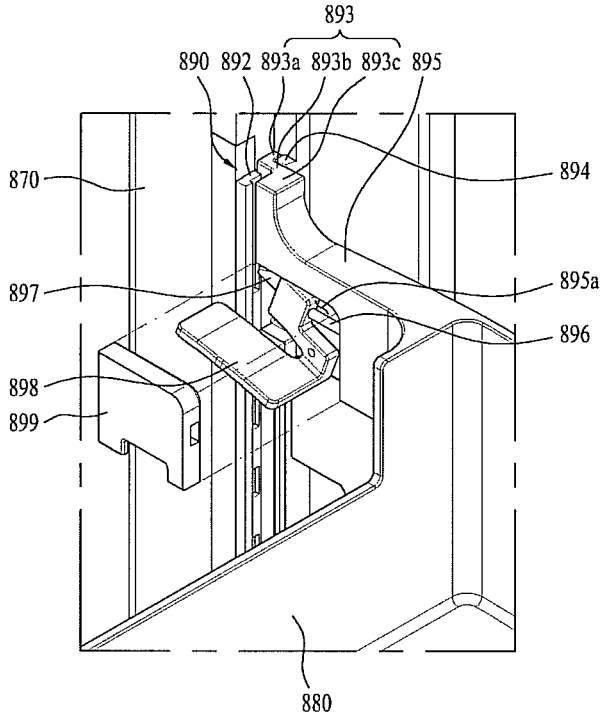

FIGS. 15 and 16 illustrate a first coupling part in detail, with the cover open. FIG. 15 shows a hook engaged in a groove of a first guide member and FIG. 16 shows the hook pivoted in a clockwise direction and not engaged the groove of the first guide member.

The first fixing part 890 may include a first guide member 892 and a second guide member 894 installed on the inner door 870, and a movable member 893 that is movable between the first guide member 892 and the second guide member 894. The movable member 893 may be installed in the auxiliary basket 880, different from the first guide member 892 and the second guide member 894.

The first guide member 892 and the second guide member 894 may extend longitudinally along a vertical surface of the inner door 870. The auxiliary basket 880 may be movable to a predetermined extendible range of the first and second guide members 892 and 894.

The movable member 893 may include a supporting piece 893*b* having two sides supported by the first and second guide members 894, respectively. The supporting piece 893*b* may ascend/descend vertically between the first and second guide members 892 and 894 in the space formed between the first and second guide members 892 and 894. The supporting piece 893*b* may be formed in a rectangular bar shape to enable the sides thereof to maintain surface contact with and be supported by the first and second guide members 892 and 894.

A first bent piece 893*a* may extend toward the second guide member 894 from an end of the supporting piece 893*a* and a second bent piece 893*b* may extend toward the first guide member from the other end of the supporting piece 893*b*. The first bent piece 893*a* and the second bent piece 893*c* may extend in opposite directions from different positions so that the first bent piece 893*a*, the supporting piece 893*b* and the second bent piece 893*c* may form a

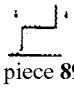

shape. The first bent piece 893*a* and the second bent piece 893*c* may extend in different directions with respect to the supporting piece 893*b*, providing for the stable coupling of the supporting piece 893*b* between the first guide member 892 and the second guide member 894.

The first guide member 892 may be, for example, a rack having a plurality of grooves formed therein. The plurality of the grooves may be formed in the first guide member 892 linearly, spaced apart a predetermined distance from each other, and the first guide member 892 may extend longitudinally in a vertical direction of the inner door 870.

An extended piece 895 may be provided in a connecting portion between the second bent piece 893*c* and the auxiliary basket 880 to space the auxiliary basket 880 apart a predetermined distance from the extended piece 895. A recessed part 895*a* may be formed as a recess in the extended piece 895 having a predetermined depth and a cover 899 may cover the recessed part 895*a*. The recessed part 895*a* may be formed adjacent to a portion facing the first guide member 892 or to the second bent piece 893*c*. A hook 897 may be installed in the recessed part 895*a* to be securely hooked to one of the grooves.

An elastic member 896 may be provided at an end of the hook 897 to elastically support the hook 897 coupled by a pivot. The elastic member 896 may have a restoring force with respect to a compressive force. When the user rotates the hook 897 in a clockwise direction in the state shown in FIG. 15, the elastic member 896 may be compressed as shown in FIG. 16 and the hook 897 may be rotated in a clockwise direction. Once the force applied by the user is removed, the hook 897 may be rotated in a counter-clockwise direction by the restoring force of the elastic member 896 as shown in FIG. 15.

When the elastic member 896 is compressed sufficiently as shown in FIG. 15, the hook 897 may be inserted in one of the grooves provided in the first guide member 892 and the position of the auxiliary basket 880 may be fixed. In contrast, to change the position of the auxiliary basket 880 the user may rotate the hook 897 in a clock-wise direction and the hook 897 may be detached from the groove, to adjust the auxiliary basket 880 to a desired height.

Different from what is shown in FIG. 15, the elastic member 896 may be a leaf spring or coil spring that is able to generate a restoring force with respect to a compressive force.

A seating protrusion may be formed opposite the elastic member 896 with respect to the hook 897, to limit a rotational passage of the hook 897. The seating protrusion may have a surface that is able to maintain surface-contact with the hook 897. When the hook 897 is contacting the seating protrusion, the counter-clockwise direction rotation of the hook 897 is limited and the hook 897 is stopped. In other words, the hook 897 would be rotated in the counter-clockwise direction by the restoring force of the elastic member 896 continuously. However, the hook 897 is not rotated in the counter-clockwise direction a predetermined angle or more, because of the seating protrusion.

The first fixing part 890 may also include an operation piece 898 for rotating the hook 897 about the axis. The operating piece 898 may extend from the hook 897 and the user may hold and move the operating piece 898 to rotate the hook 897.

The operating piece 898 may be exposed to provide access to the user even when the cover 899 is installed. The user may operate the operating piece 898 in a state in which the cover 899 closes the recessed part 895*a*, which may improve user convenience.

The cover 899 may extend across the recessed part 895*a* to prevent the hook 897 and the elastic member 896 from being exposed to the outside.

Figure 18:
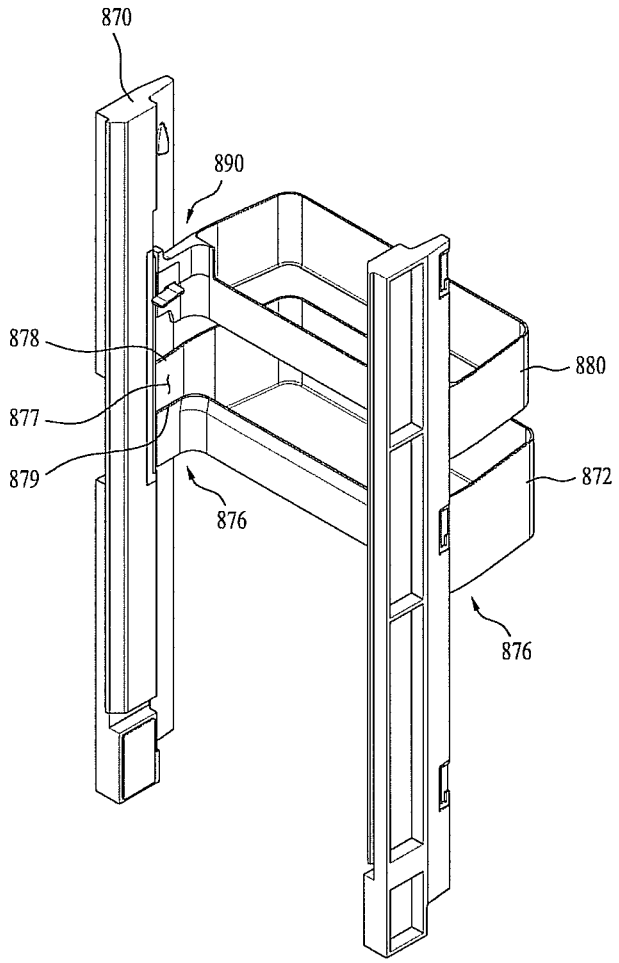
FIG. 18 is a perspective view of a modified example of the embodiment shown in FIG. 13.
Figure 19:
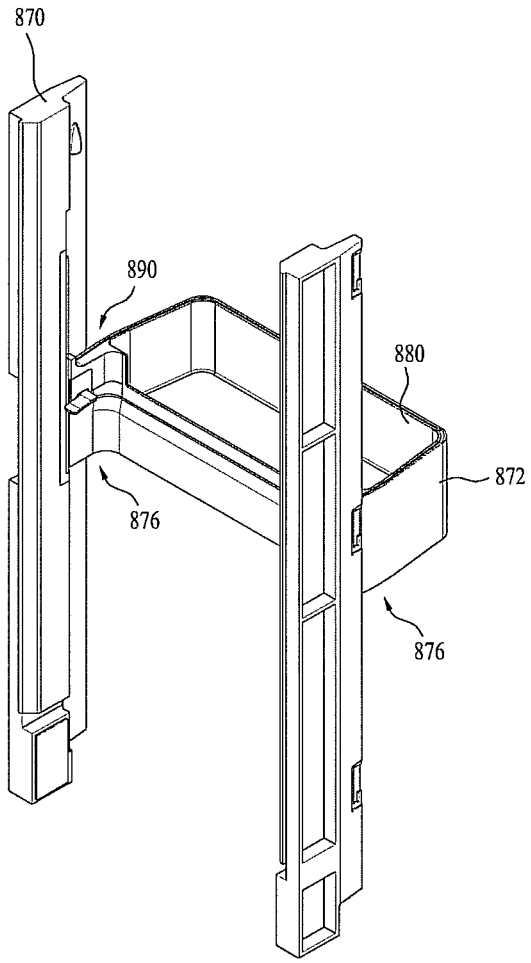
FIG. 19 illustrates a state in which a sub-basket of the storage assembly as shown in FIG. 18 is moved and overlapped with a top surface of a main-basket.

FIG. 18 is a perspective view of a modification the embodiment shown in FIGS. 13 to 17, seen from the front. FIG. 19 illustrates a state in which an auxiliary basket shown in FIG. 18 is moved to a top surface of a main-basket to be overlapped with, or contained within the confines of, the main-basket.

In the embodiment shown in FIGS. 18 and 19, a bottom surface of the auxiliary basket 880 is open, different from the embodiment shown in FIGS. 13 to 17 described above. Other components of this embodiment are the same as or similar to the corresponding components of the embodiment described above, except the shape of the auxiliary basket 880. The bottom surface of the main-basket 872 is closed in this embodiment, similar to the embodiment described above.

When the bottom surface of the auxiliary basket 880 is open, the height of the auxiliary basket 880 may be adjusted and the items stored in the main-basket 872 may be stored stably. When the items stored in the main-basket 872 are tall bottles such as beverage bottles and the tall bottles are accommodated only in the main-basket, the bottles may shake or move out of the main-basket 872. In this instance, when the auxiliary basket 880 is moved upwardly from the main-basket 872, a middle area of a beverage bottle may be supported by the auxiliary basket 880 and the beverage bottle may be prevented from falling from the inner door 870.

In contrast, when the beverage bottle stored in the main-basket 872 is taken out, the auxiliary basket 880 may be moved downwardly and then the beverage bottle may be taken out of the main-basket 872. When the auxiliary basket 880 is moved downwardly, the exposed space of the bottle may be increased and the bottle may be more easily accessible. The structure of the auxiliary basket 880 that generates the upward and downward movement is essentially the same as the structure of the auxiliary basket according to the embodiment described above.

In other words, in this embodiment, the auxiliary basket 880 may be accommodated in the main-basket 872 and overlap the main-basket. In this instance, the structure shown in FIG. 19 is formed.

A refrigerator is provided including a moving basket provided in a first door, the moving basket being vertically movable in a storage assembly opened and closed by a second door, with an adjustable height by an operation device, to utilize an internal space of the storage assembly efficiently.

A refrigerator is provided that is able to utilize a predetermined space installed in an internal door provided in a freezer or refrigerator compartment.

A refrigerator as embodied and broadly described herein may include a cabinet for defining a first storage chamber; a first door for opening and closing the first storage chamber; a storage case coupled to the first door, the storage case for defining a second storage chamber to store foods therein; an opening formed through the first door, in communication with an open front of the second storage chamber; a second door for opening and closing the second storage chamber, connected with the first door; a moving basket provided in the storage case, the moving basket that is movable along the storage case in a vertical direction; a rail provided in the second storage chamber, the rail extended in a vertical direction to guide the movement of the moving basket; and an operation mechanism provided in the moving basket to enable the moving basket to be restricted to the rail by a user's operation, wherein the operation mechanism is partially exposed via the opening to be operated by the user after the user opens the second door.

The moving basket may partition an inner space of the storage case into upper and lower spaces.

A plurality of rails may be provided in right and left sides of the storage case.

The rail may be arranged closer to the right and left sides than the opening and it may be hidden by both sides of the opening, see in the front.

The rail may be provided in a front end of the storage case, corresponding to a rear surface of the first door.

A roller may be accommodated in the rail in the moving basket.

The operation mechanism may be provided in each of the sides of the moving basket corresponding to the rail. The operation mechanism may include an operation lever provided in the moving basket, the operation lever rotated by the user's operation; a restricting member rotated in communication with the rotation of the operation lever, the restricting member inserted in a plurality of adjusting grooves formed in the rail to restrict the moving basket; and an elastic member provided in the restricting member, the elastic member restituted to an initial position after the restricting member or the operation lever is operated.

The moving basket may include a drawer installed via the opening; and a guide member for guiding inward and outward movement of the drawer.

The moving basket may include a moving main-basket for partitioning an inner space of the storage case, the moving main-basket in which foods are accommodated; a drawer accommodated in the moving main-basket, the drawer movable outwardly with respect to the opening; and a guide member coupled to the moving main-basket, the guide member for guiding the inward and outward sliding movement of the drawer.

A plurality of adjusting grooves may be formed in the rail, spaced apart a predetermined distance from each other in a vertical direction and an operation mechanism may be provided in the guide member. The operation mechanism may be inserted in the adjusting groove by the user's operation to fix the moving basket.

A roller may be provided in the guide member to be inserted in the rail to guide the movement of the moving basket.

An upper basket may be provided in the storage case to open and close a top surface of the storage case and the upper basket may be open toward the opening to provide a storage space independent from the second storage chamber.

The upper basket may include a basket tray mounted in the storage case, the basket tray for defining a storage space where foods are stored; and a basket cover pivotally coupled to the basket tray, the basket cover for opening and closing the storage space of the basket tray.

The upper basket cover may be rotated in a state where the first door is open.

In another embodiment as broadly described herein, a refrigerator may include an inner door pivotally mounted in an outer door for opening and closing a freezer compartment or a refrigerator compartment; a sub-basket coupled to the inner door, with being movable vertically; a first fixing part for fixing the sub-basket to the inner door, wherein the first fixing part includes a first guide member and a second guide member installed in the inner door and a movable member movably provided between the first guide member and the second guide member, and the first fixing part is arranged in front of a storage space provided in the sub-basket to store foods therein, The movable member may include a supporting piece comprising both sides supported by the first guide member and the second guide member, respectively; and a first bent piece extended toward the second guide member from the supporting piece.

The movable member may further include a second bent piece extended toward the first guide member from the supporting piece.

The first guide member may be a rack having a plurality of grooves formed therein, and a hook may be installed in the movable member to be hooked to one of the plurality of the grooves.

The refrigerator may further include a main-basket fixed to the inner door; and a second fixing part for fixing the main-basket to the inner door, wherein the main-basket may be installed below the sub-basket and an accommodation space may be provided in the second fixing part to accommodate the movable member.

The second fixing part may include a first fixing piece and a second fixing piece for connecting the main-basket to the inner door, and the accommodation space may be a predetermined space formed between the first fixing piece and the second fixing piece spaced apart from each other.

The sub-basket may be movable downwardly to the same height as the main-basket.

The sub-basket and the main-basket may be overlapped with each other when the sub-basket is moved downwardly to the same height as the main-basket.

A bottom surface of the sub-basket may be open.

In a refrigerator as embodied and broadly described herein, the moving basket accessible to the inside of the storage case when the second door is open may be movable vertically in the storage case so that a height proportion of the upper and lower spaces with respect to the moving basket in the storage case may be adjusted.

As a result, the user may adjust the inner space of the second storage chamber provided in the storage case appropriately to store various foods having various heights. Accordingly, space efficiency and a storage ability may be enhanced.

Furthermore, as the moving basket may be movable along the rail provided in the storage case and it may be movable vertically in the storage case, the storage space may be adjusted freely in a state in which foods are stored in the second storage chamber.

Additionally, as the rail for guiding the vertical movement of the moving basket may be provided in the front end of the storage case, outside of the opening and not exposed to the outside when the second door is open, the inner structure of the storage case may be simplified and storage space may be maximized. Still further, the storage space may be adjustable while the moving basket is mounted, without having to detach the moving basket for adjustment. The operation mechanism may be exposed via the opening when the second door is open and the user may operate the operation mechanism via the opening, so that the vertical height of the moving basket may be easily adjusted. As a result, the user can move the moving basket in a vertical direction more conveniently and adjust the space of the second storage chamber.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet that defines a first storage chamber; and a main door coupled to the cabinet, wherein the main door includes:

a first door having an outer portion defined to be opposite the cabinet and an inner portion defined to be opposite the outer portion, and an opening that passes through the inner portion and the outer portion:

a storage case coupled to an interior side of the first door, that defines a second storage chamber, wherein the opening, which is formed through the first door, is in communication with an open front of the second storage chamber;

a first basket coupled to the first door so as to be vertically movable, the first basket having a storage space to receive and store food therein, wherein the first basket, which is provided in the storage case, is vertically movable within the storage case;

an operating portion configured to vertically move the first basket;

a coupling portion configured to couple the first basket to the first door, wherein the coupling portion is provided at the outer portion of the first door, wherein the coupling portion maintains a distance between the first basket and the first door constant while the first basket moves vertically, wherein the operation portion is positioned closer to a user than the storage space of the first basket such that the user operates the operating portion by passing through the opening, but not passing through the storage space of the first basket, wherein the coupling portion is positioned closer to a user than the storage space of the first basket such that the operation portion and the coupling portion are connected to each other at an outer portion of the storage space of the first basket without passing through the storage space of the first basket;

a second door coupled to the first door at a position corresponding to the open front of the second storage chamber to open and close the second storage chamber; and at least one rail that extends vertically in the second storage chamber to guide movement of the first basket, wherein, in a first mode of the main door, the first storage chamber is accessible using the first door and the second storage chamber is inaccessible, and in a second mode of the main door, the second storage chamber is accessible using the second door and the first storage chamber is inaccessible, and wherein the operation portion is partially exposed via the opening in the first door such that a user can operate the operation portion via the opening in the first door when the second door is rotated away from the first door in the second mode, wherein the first basket includes:

a moving basket, in which storage items are received;

a drawer slidably coupled at a bottom of the moving basket and movable inwardly and outwardly via the opening in the first door; and a guide member that guides the inward and outward movement of the drawer.

2. The refrigerator of claim 1, wherein in a third mode of the main door, the first and second storage chambers are both accessible.

3. The refrigerator of claim 2, wherein, in the first mode, the second door is closed against the first door and the first and second doors are rotated away from the cabinet to provide access to the first storage chamber, and in the second mode, the second door is rotated away from the first door with the first door positioned against the cabinet to provide access to the second storage chamber.

4. The refrigerator of claim 3, wherein, in the third mode, the main door is rotated away from the cabinet to provide access to the first storage chamber, and the second door is rotated away from the first door to provide access to the second storage chamber.

5. The refrigerator of claim 1, wherein the operation portion is coupled between the first basket and the at least one rail to selectively restrict movement of the first basket, and wherein the operation portion is partially exposed via the opening in the first door when the second door is rotated away from the first door in the second mode.

6. The refrigerator of claim 5, wherein the operation portion includes:

an operation lever rotatably coupled to the first basket, that extends outward from the first basket so as to be exposed when the second door is rotated away from the first door;

a restricting lever coupled to the operation lever and rotated in response to rotation of the operation lever, wherein the restricting lever is configured to be inserted into one of a plurality of adjusting grooves formed in the at least one rail to restrict a moving position of the first basket in the storage case; and an elastic member coupled to the restricting lever, wherein the elastic member restores an initial position of the restricting lever and the operation lever after the restricting lever and the operation lever are rotated.

7. The refrigerator of claim 1, wherein the moving basket and the drawer slide together within the storage case along the at least one rail to adjust a vertical position thereof within the storage case.

8. The refrigerator of claim 1, further including a second basket fixed at an upper end of the storage case to open and close a top surface of the storage case, wherein an open portion of the second basket is oriented toward the opening in the first door to provide a storage space that is separated from the second storage chamber.

9. The refrigerator of claim 8, wherein the second basket includes:

a basket tray provided in the storage case, that defines the storage space, which is separated from the second storage chamber; and a basket cover rotatably coupled to the basket tray that opens and closes the open portion of the basket tray.

10. A refrigerator, comprising:

a cabinet that defines a main storage space; and a main door coupled to the cabinet, wherein the main door includes an outer door and an inner door, the inner door including an outer portion defined to be opposite the cabinet and an inner portion defined to be opposite the outer portion, and an opening that passes through the inner portion and the outer portion, and wherein the inner door further includes:

a first basket coupled to the inner door so as to be vertically movable, the first basket having a basket storage space to receive and store food therein, wherein the first basket, which is coupled to the inner door, is movable vertically along the inner door;

an operating portion configured to vertically move the first basket;

a second basket fixed to the inner door, wherein, in a nested mode, the first basket is slidably positioned at a same height as the second basket such that the first and second baskets overlap each other when the first basket is moved downward to the same height as the second basket;

a first coupling portion configured to couple the first basket to the inner door, wherein the coupling portion is provided at the outer portion of the inner door, wherein the first coupling portion maintains a distance between the first basket and the inner door constant while the first basket moves vertically, wherein the operation portion is positioned closer to a user than the basket storage space such that the user operates the operating portion by passing through the opening, but not passing through the basket storage space, wherein the first coupling portion is positioned closer to a user than the basket storage space such that the operation portion and the first coupling portion are connected to each other at an outer portion of the basket storage space without passing through the basket storage space, and wherein, the first coupling portion includes:

a first guide member and a second guide member that extend vertically along an installation surface of the inner door; and a movable member received between the first guide member and the second guide member such that the first and second guide members guide movement of the moveable member, wherein the first coupling portion is arranged in front of the basket storage space provided when the inner door is closed against the cabinet and the outer door is rotated away from the inner door to provide access to the basket storage space, and wherein the operation portion is partially exposed via the opening in the inner door such that a user can operate the operation portion via the opening in the inner door when the outer door is rotated away from the inner door.

11. The refrigerator of claim 10, wherein the movable member includes:

a supporting piece provided at a distal end of an extension piece that extends outward from a front end of the first basket, the supporting piece having two opposite sides thereof respectively supported by the first guide member and the second guide member; and a first bent piece that extends outward from the supporting piece toward the second guide member.

12. The refrigerator of claim 10, wherein the first guide member includes a rack having a plurality of grooves formed therein, and wherein the moveable member includes a hook configured to be engaged in one of the plurality of the grooves to selectively fix a vertical position of the first basket on the inner door.

13. The refrigerator of claim 10, further including:

a second basket fixed to the inner door; and a second coupling portion that fixes the second basket to the inner door, wherein the second basket is installed below the first basket, and wherein the second coupling portion includes an accommodation space to accommodate the movable member of the first coupling portion therein.

14. The refrigerator of claim 13, wherein the second coupling portion includes:

a first fixing piece and a second fixing piece spaced apart from the first fixing piece, wherein the first and second fixing pieces fix the second basket to the inner door, and wherein the accommodation space is formed between the first fixing piece and the second fixing piece.

15. The refrigerator of claim 14, wherein, in a nested mode, the first basket is slidably positioned at the same height as a second basket and received within the second basket.

16. The refrigerator of claim 13, wherein the first coupling portion includes a pair of first coupling devices respectively provided at two opposite ends of the first basket, and wherein the second coupling portion includes a pair of second coupling devices respectively provided at two opposite ends of the second basket, at positions respectively corresponding to the pair of first coupling devices.

17. The refrigerator of claim 10, wherein a bottom surface of the first basket is open.

* * * * *